US007252606B1

(12) United States Patent
Lee

(10) Patent No.: US 7,252,606 B1
(45) Date of Patent: Aug. 7, 2007

(54) CLAMPING DEVICE FOR CLAMPING STRINGS OF STRINGING MACHINE FOR SPORT RACKETS

(76) Inventor: Min-Wei Lee, P.O. Box 55-124, Taichung (TW)

( * ) Notice: Subject to any disclaimer, the term of this patent is extended or adjusted under 35 U.S.C. 154(b) by 0 days.

(21) Appl. No.: 11/473,239

(22) Filed: Jun. 23, 2006

(51) Int. Cl.
*A63B 51/14* (2006.01)
*E05B 3/00* (2006.01)

(52) U.S. Cl. ..... 473/557; 473/555; 473/556

(58) Field of Classification Search ..... 473/557, 473/555, 556; 292/256, 336.3, 347, 348, 292/DIG. 37, 163, 173
See application file for complete search history.

(56) References Cited

U.S. PATENT DOCUMENTS 5,090,697 A * 2/1992 Lee ..... 473/555
6,398,674 B2 * 6/2002 Tsuchida ..... 473/557
6,533,687 B1 * 3/2003 Lee ..... 473/557
6,764,418 B1 * 7/2004 Lee ..... 473/557

FOREIGN PATENT DOCUMENTS

EP 460297 A1 * 12/1991

* cited by examiner

*Primary Examiner*—Brian E. Glessner
*Assistant Examiner*—Alyson Merlino

(57) ABSTRACT

A clamping device for stringing machine includes a slide member, a positioning device, a control device and a rail. The positioning device and a tube are located on two ends of the slide member. An extension of a clamping device is inserted into the tube. The control device includes a pin, a ring-shaped member and a knob. The pin is pivotably connected with the knob. A torsion spring is received in an annular space of the knob so as to rotate the knob to its original position. The tube includes an engaging section and a receiving section. The receiving section has a positioning pin and a spring which biases the positioning pin so as to move the positioning pin axially. The knob having a pin hole defined in an underside thereof and can be securely positioned by inserting the insertion member into the pin hole.

3 Claims, 6 Drawing Sheets

CLAMPING DEVICE FOR CLAMPING STRINGS OF STRINGING MACHINE FOR SPORT RACKETS

FIELD OF THE INVENTION

The present invention relates to a clamping device, and more particularly, to a clamping device for clamping strings of stringing machine for sport rackets.

BACKGROUND OF THE INVENTION

A conventional clamping device of stringing machine is shown in FIG. 1 and generally includes a body 1, a tapered member 2, a base 3, a knob 4 and a slide block 5. The body 1 has a tapered hole 101, a recess 102 and a tube 103 which extends upward from the body 1. The tapered member 2 is engaged with the tapered hole 101 and a protrusion 201 and a stop block 202 are fixed to an underside of the tapered member 2 so as to be connected to the rail of the stringing machine. The tube 103 receives the clamping device which is not shown. The base 3 is engaged with the recess 102 and includes a shaft 301 which has an eccentric section 302. A notch 303 is defined in the base 3 and located corresponding to the notch 303. The knob 4 is connected to a top of the shaft 301. A slot 104 is defined between the tapered hole 101 and the recess 102 so that the slide block 5 is engaged with the slot 104. The slide block 5 has a bolt 501 at an end thereof and the bolt 501 faces the recess 102 so as to be in contact with the eccentric section 302 of the shaft 301. A cap 502 is mounted to the contact surface between the bolt 501 and the eccentric section 302. The slide block 5 has an inclined surface 503 which is in contact with tapered member 2 and matches with the tapered member 2.

When positioning the body 1 to prevent the clamping device from shifting, the knob 4 is rotated so that the eccentric section 302 pushes the bolt 501 and the slide block 5 moves horizontally such that the tapered member 2 is pushed upward by the inclined surface 503. The stop block 202 is in contact with the rail 9 so that the body 1 is positioned and does not rotate. When the body 1 is to be released from the position, the knob 4 is rotated in opposite direction and the torsion spring 401 in the knob 4 rotates the knob 4 at high speed and back to its original position. The eccentric section 302 of the shaft 301 is no in contact with the bolt 501 so that the stop block 202 is disengaged form the rail 9. The tapered member 2 is lowered due to the gravity and the body 1 is freely rotated and moved along the rail 9.

It is noted that when the knob 4 is rotated to secure the body 1, during the stringing processes, the knob 4 might be rotated unintentionally by the user. Because the clamping device does not have a positioning feature, the knob 4 is easily rotated in opposite direction by the torsion spring 401. This shortcoming makes stringing machine to be un-reliable.

The present invention intends to provide a clamping device which improves the shortcoming mentioned above so that the stringing machine is more reliable.

SUMMARY OF THE INVENTION

The present invention relates to a clamping device for stringing machine, wherein the clamping device comprises a slide member, a positioning device, a control device and a rail. The rail is located at a top of the stringing machine and a slot is defined in the rail. The positioning device is located at an end of the slide member and a tube is located at the other end of the slide member. An extension of a clamping device is inserted into the tube. The control device includes a pin, a ring-shaped member and a knob. The ring-shaped member is engaged with the slide member and the pin is pivotably connected with the ring-shaped member. The pin is pivotably connected with the knob. An annular space is defined in a top of the ring-shaped member and a torsion spring is received in the annular space. Two ends of the torsion spring are connected to the slide member and the knob respectively.

The knob has a pin hole defined in an underside of the knob and the slide member has a pivotal hole. The tube includes an engaging section and a receiving section. The engaging section is inserted into the insertion hole and a lower end of the engaging section is in contact with a top of the slide member. The receiving section has a positioning pin and a spring which biases the positioning pin so as to move the positioning pin axially. The tube has a slit which is located in the receiving section. The slide member has an insertion slot which communicates with the pivotal hole. The insertion slot extends to an underside of the knob. The positioning pin includes a piece and an insertion member. The piece is received in the receiving section and the insertion member is engaged with the insertion slot. The piece and the insertion member are connected with each other by connection portion which is pivotably engaged with the slit. The knob is secured by inserting the insertion member into the pin hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
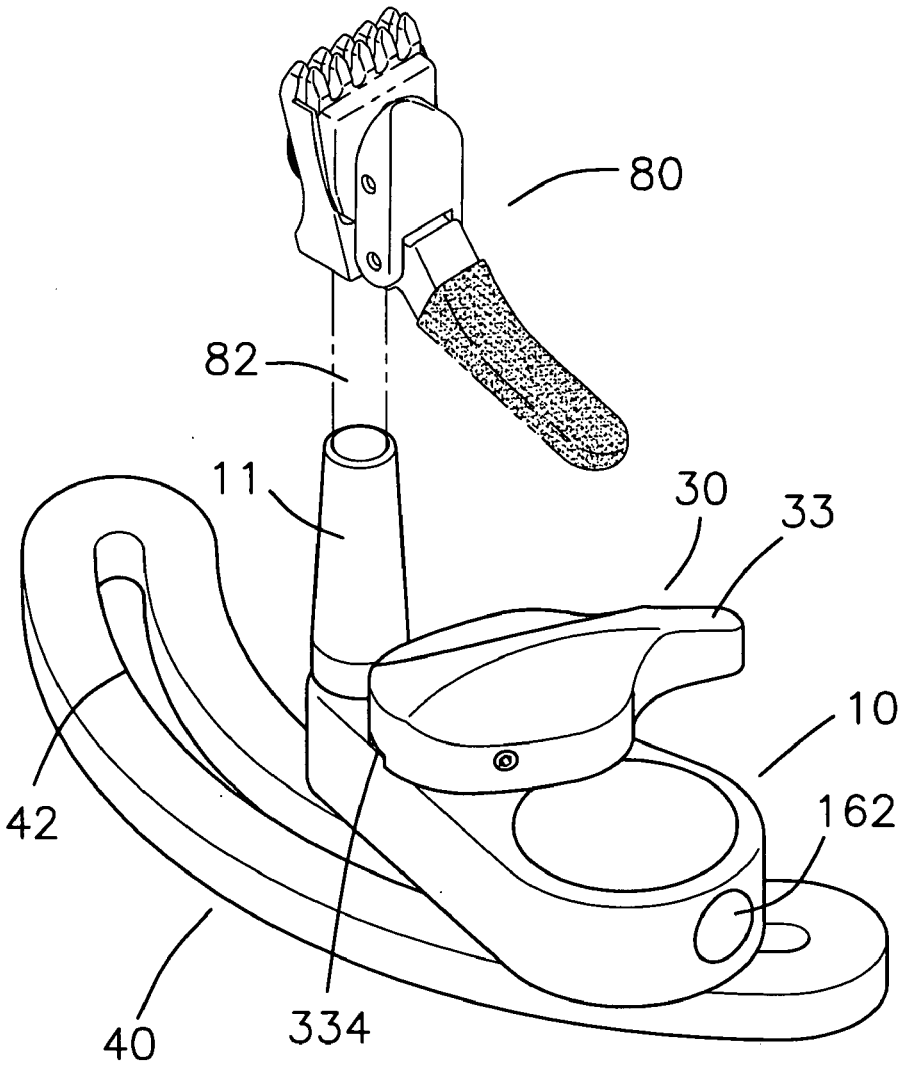
FIG. 2 is a perspective view to show the clamping device of the present invention.
Figure 3:
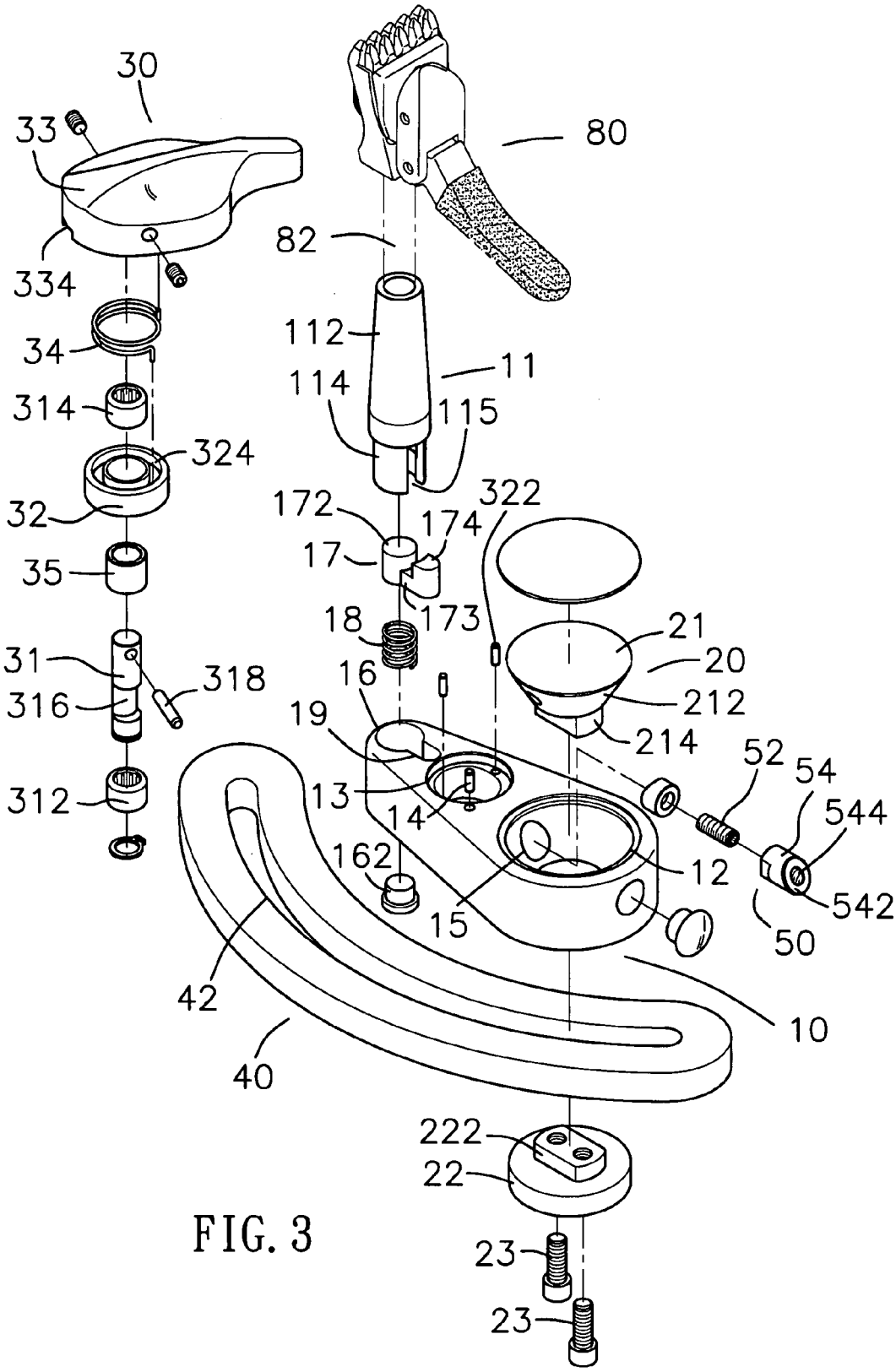
FIG. 3 is an exploded view to show the clamping device of the present invention.

Referring to FIGS. 2 and 3, the clamping device of stringing machine of the present invention comprises a slide member 10, a positioning device 20, a control device 30 and a rail 40. The rail 40 is located at a top of the stringing machine and a slot 42 is defined in the rail 40. The positioning device 20 is located at an end of the slide member 10 and a tube 11 is located at the other end of the slide member 10. An extension 82 of a clamping device 40 is inserted into the tube 11. The control device 30 is located between the positioning device 20 and the tube 11.

Figure 4:
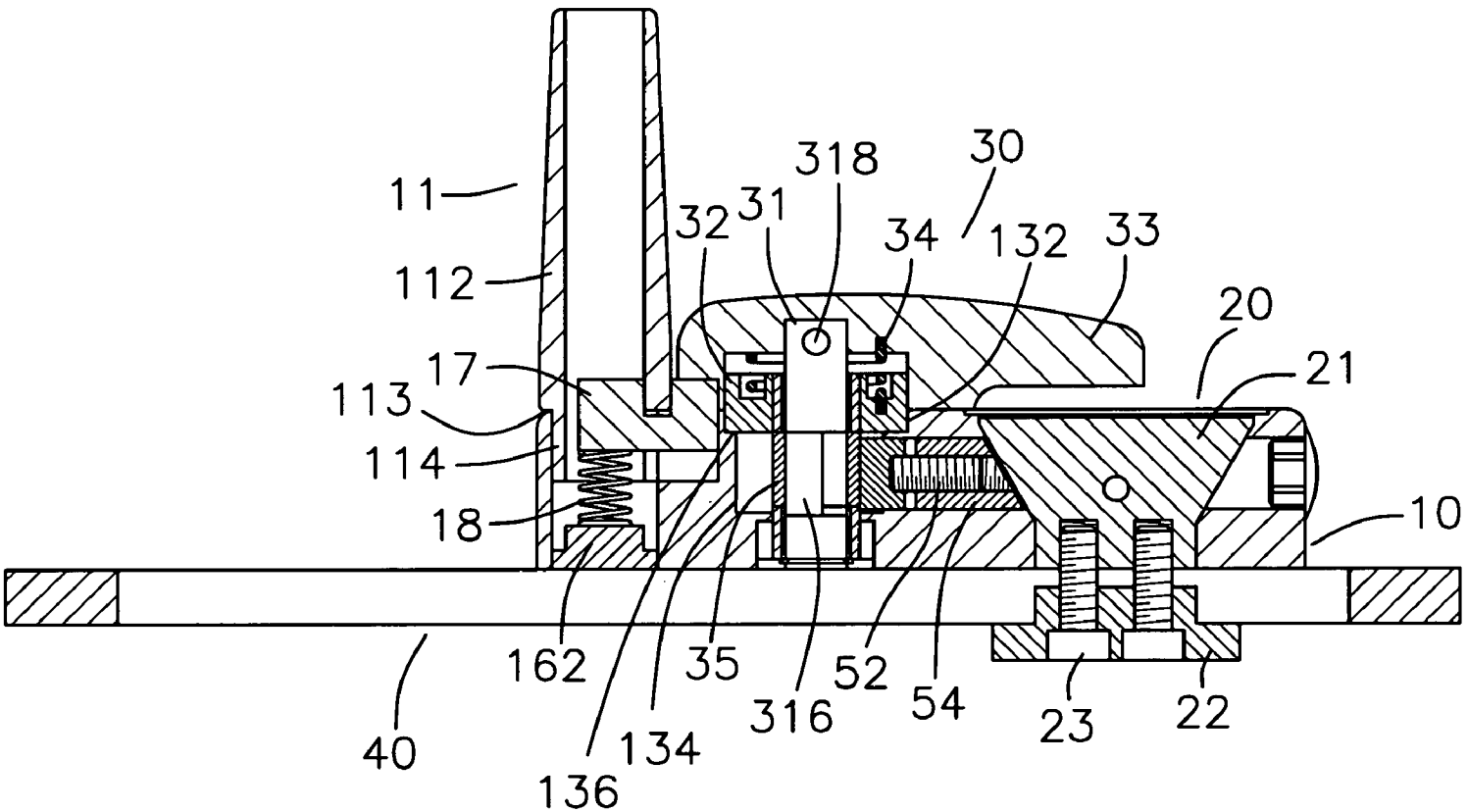
FIG. 4 is a side cross sectional view of the clamping device of the present invention.

As shown in FIG. 4, the positioning device 20 includes a cap 21 and a stop block 22, wherein the diameter of the cap 21 is reduced gradually from the top to the bottom so that the cap 21 has a tapered outer surface 212. A rectangular engaging block 214 is connected to an underside of the cap 21 and the slide member 10 has an engaging hole 12. The cap 21 is engaged with the engaging hole 12 and the engaging block 214 is engaged with the slot 42. The stop block 22 is a rectangular block and a rectangular protrusion 222 extends from a top of the stop block 22, the protrusion 222 is engaged with the slot 42. The cap 21 and the stop block 22 are connected with each other by a plurality of adjusting bolts 23 so that the cap 21 moves the stop block 22 and the stop block 22 stops the rail 40 to position the slide member 10.

Figure 1:
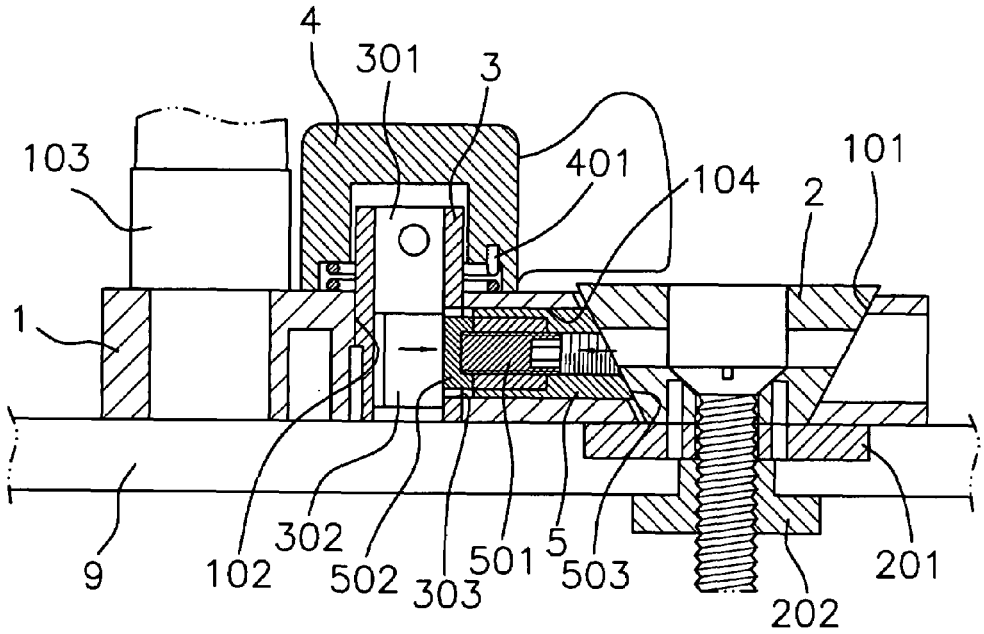
FIG. 1 PRIOR ART
FIG. 1 shows a conventional clamping device of stringing machine.
Figure 5:
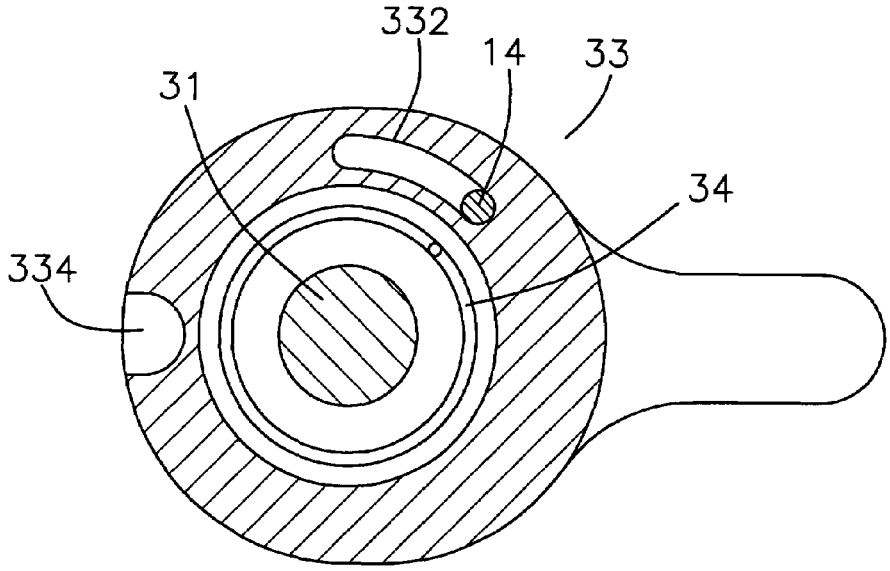
FIG. 5 shows a cross sectional view of the knob.

The control device 30 including a pin 31, a ring-shaped member 32 and a knob 33. The slide member 10 has a T-shaped insertion hole 13 which is composed of a securing section 132 in the top of the slide member 10 and a pivotal section 134 in the bottom of the slide member 10. The inner diameter of the securing section 132 is larger than that of the pivotal section 134. An annular limitation surface 136 is formed a joint portion between of the securing section 132 and the pivotal section 134. The ring-shaped member 32 is engaged with the securing section 132 and has a plurality of pins 322 on the bottom thereof. The pins 322 are inserted into the limitation surface 136 axially so as to limit the ring-shaped member 32 from rotation. The pin 31 is pivotably connected to the insertion hole 13 and two bearings 312, 314 are respectively connected with the ring-shaped member 32 and the pivotal section 134. The pin 31 includes an eccentric section 316 defined between the two bearings 312, 314. A shift member 35 is mounted to the eccentric section 316 and the pin 31 is pivotably connected to the knob 33 by a pin 318. An annular space 324 is defined in a top of the ring-shaped member 32 and a torsion spring 34 is received in the annular space 324. Two ends of the torsion spring 34 are connected to the annular space 324 and the knob 33 respectively. As shown in FIG. 5, the knob 33 has a restriction slot 332 defined in an underside thereof and is curved respective to the pin 31 which is located at a center of the curve. A post 14 extends from the slide member 10 and is inserted into the restriction slot 332 so as to limit the angle of rotation of the knob 33.

The slide member 10 has a chamber 15 defined therein so as to perpendicularly communicate with the engaging hole 12 and the insertion hole 13. An end piece unit 50 is pivotably received in the chamber 15 and includes an adjusting bolt 52 and an end piece 54 which has an inclined end 542 matched with the push surface 212. A threaded hole 544 is defined through the end piece 54 and the adjusting bolt 52 has one end threadedly engaged with the threaded hole 544, and the other end of the adjusting bolt 52 is in contact with an outer periphery of the shift member 35. By threading the adjusting bolt 52, the end piece unit 50 is moved axially.

The knob 33 has a pin hole 334 defined in an underside thereof and the slide member 10 has a pivotal hole 16. The tube 11 includes an engaging section 112 and a receiving section 114. The engaging section 112 is inserted into the insertion hole 13 and a lower end of the engaging section 112 is in contact with a top of the slide member 10. An underside of the engaging section 112 includes a contact surface 113 which is in contact with the top of the slide member 10 so as to position the tube 11. The pivotal hole 16 is defined through the slide member 10 and a head 162 is engaged with the pivotal hole 16.

The receiving section 114 has a positioning pin 17 and a spring 18 which is biased between the head 162 and the positioning pin 17 such that the positioning pin 17 moves axially. The tube 11 has a slit 115 which is located in the receiving section 114. The slide member 10 has an insertion slot 19 which communicates with the pivotal hole 16. The insertion slot 19 extends to an underside of the knob 33. The positioning pin 17 includes a piece 172 and an insertion member 174. The piece 172 is received in the receiving section 114 and the insertion member 174 is engaged with the insertion slot 19. The piece 172 and the insertion member 174 are connected with each other by connection portion 173 which is pivotably engaged with the slit 115. The knob 33 is secured by inserting the insertion member 174 into the pin hole 334.

Figure 6:
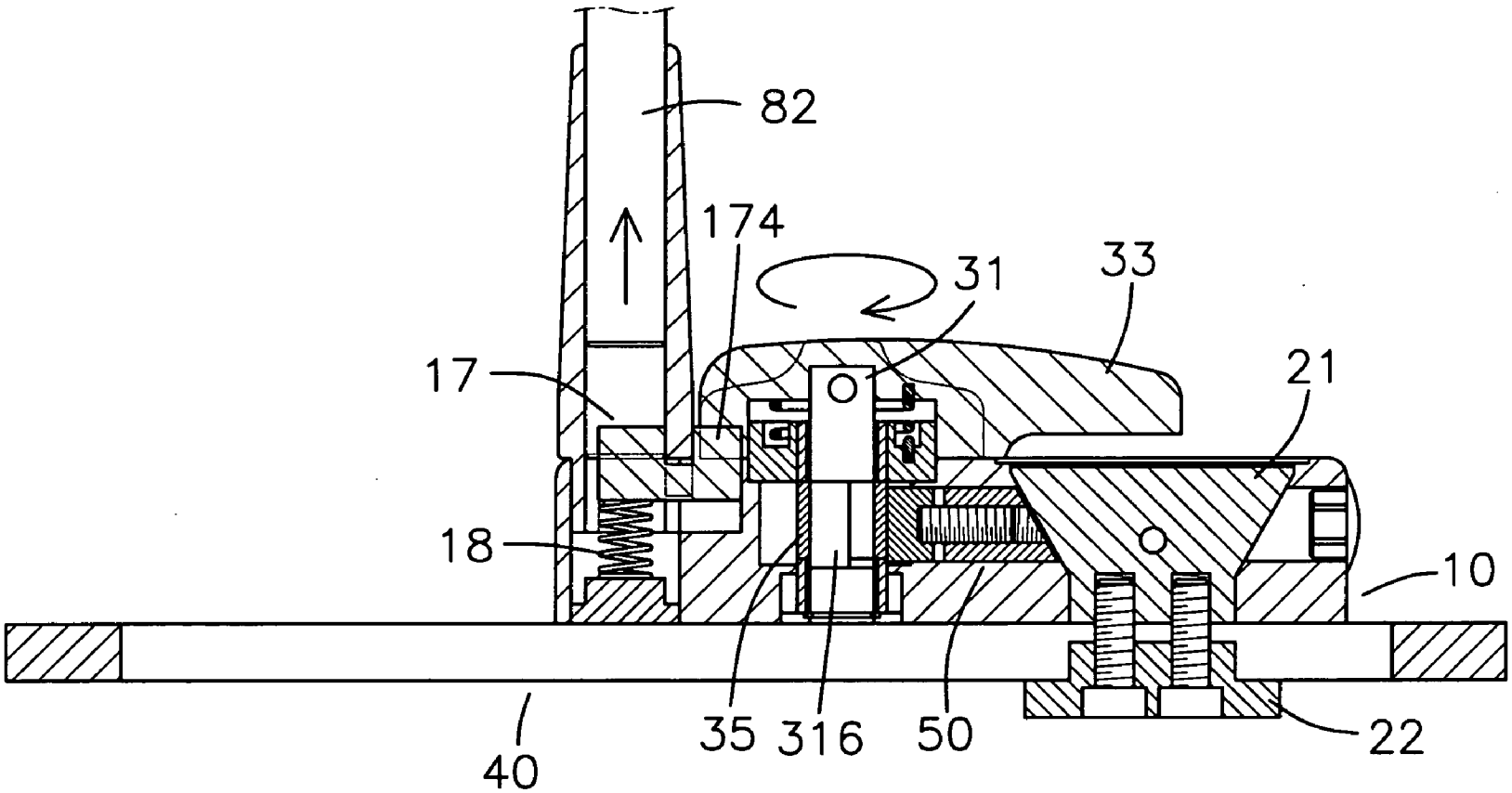
FIG. 6 shows that the clamping device is activated.
Figure 7:
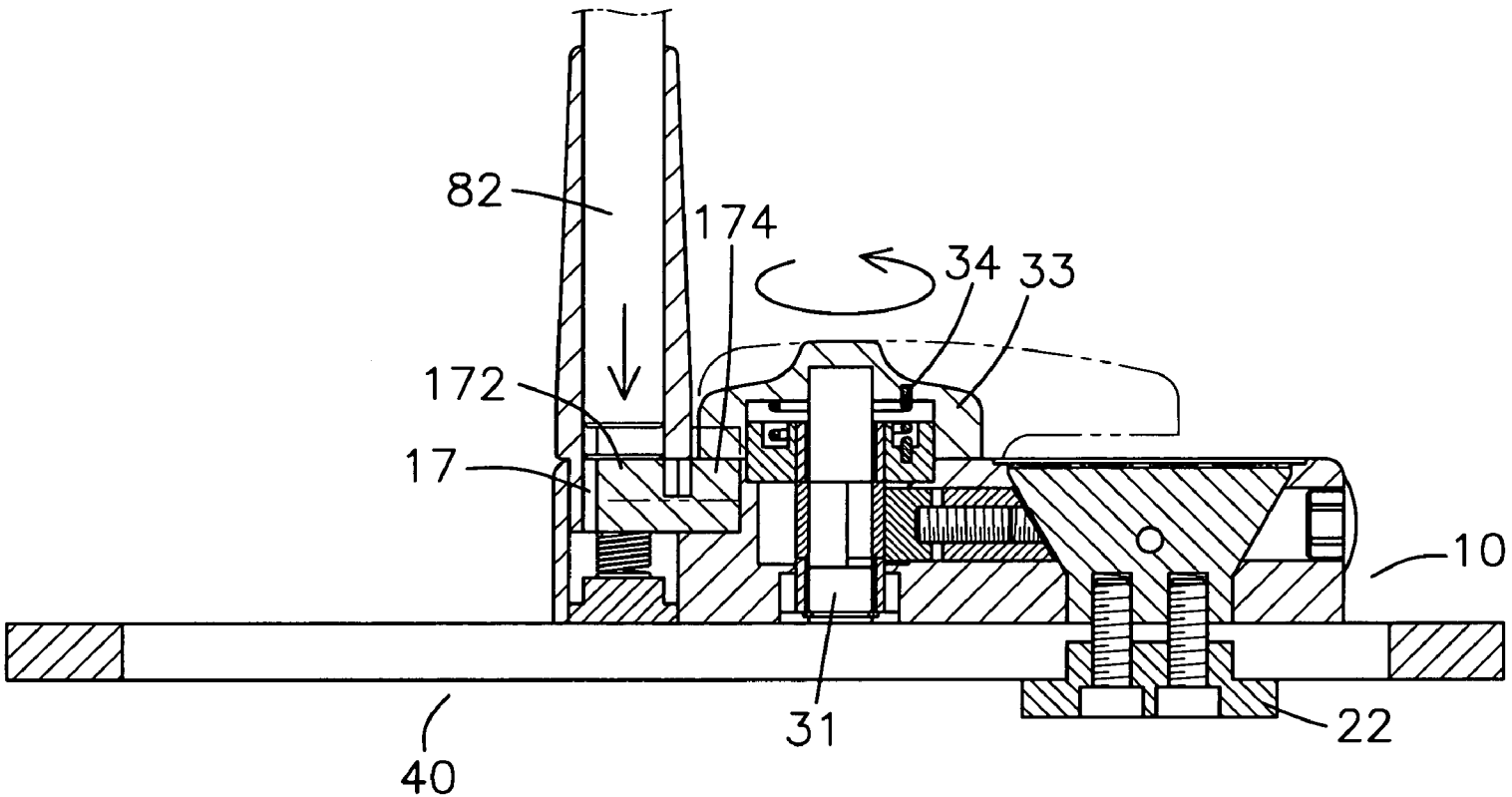
FIG. 7 shows that the clamping device is released.

As shown in FIGS. 3 and 6, during stringing the sport rackets such as tennis rackets, when the clamping device 80 moved to a desired position and moves upward so as to clamp the strings, the extension 82 moves upward with the clamping device 80. The knob 33 is rotated and drives the pin 31, the eccentric section 316 pushes the cap 21 upward by the axial movement of the end piece unit 50 which is pushed by the shift member 35. The rail 40 is stopped by the stop block 22 and the slide member 10 is also positioned. The spring 18 pushes the positioning pin 17 upward and the insertion member 174 is inserted into the pin hole 334 so as to position the knob 33. Therefore, even if the user touches the knob 33 unintentionally, the knob 33 does not rotate by the insertion member 174, and the slide member 10 is positioned too. As shown in FIGS. 3 and 7, when the clamping device 80 is to be moved to another position, after the strings are released from the clamping device 80, the extension 82 moves downward to press on the piece 172 due to gravity and the positioning pin 17 is forced to move downward so that the insertion member 174 is removed from the pin hole 334. Therefore, the knob 33 is released from the positioning pin 17 and rotates by the force of the torsion spring 34 to its original position. The rail 40 is not stopped by the stop block 22 and the slide member 10 can be rotated and/or shifted.

While we have shown and described the embodiment in accordance with the present invention, it should be clear to those skilled in the art that further embodiments may be made without departing from the scope of the present invention.

What is claimed is:

1. A clamping device for stringing a machine, comprising:

a slide member, a positioning device, a control device and a rail, the rail adapted to be located at a top of the stringing machine and a slot defined in the rail, the positioning device located at an end of the slide member and a tube located at the other end of the slide member, an extension of a clamping device inserted into the tube, the control device located between the positioning device and the tube;

the control device including a pin, a ring-shaped member and a knob, the ring-shaped member engaged with the slide member and the pin pivotably connected with the ring-shaped member, the pin pivotably connected with the knob, an annular space defined in a top of the ring-shaped member and a torsion spring received in the annular space, two ends of the torsion spring connected to the slide member and the knob respectively, and the knob having a pin hole defined in an underside thereof and the slide member having a pivotal hole, the tube including an engaging section and a receiving section, the engaging section inserted into an insertion hole and a lower end of the engaging section being in contact with a top of the slide member, the receiving section having a positioning pin and a spring which biases the positioning pin so as to move the positioning pin axially, the tube having a slit which is located in the receiving section, the slide member having an insertion slot which communicates with the pivotal hole, the insertion slot extending to an underside of the knob, the positioning pin including a piece and an insertion member, the piece received in the receiving section and the insertion member engaged with the insertion slot, the piece and the insertion member being connected with each other by a connection portion which is pivotably engaged with the slit, the knob being secured by inserting the insertion member into the pin hole.

2. The device as claimed in claim 1, wherein the pivotal hole is defined through the slide member and a head is engaged with the pivotal hole, the spring is biased between the head and the positioning pin such that the positioning pin moves axially.

3. The device as claimed in claim 1, wherein an underside of the engaging section includes a contact surface which is in contact with the top of the slide member so as to position the tube.

* * * * *